US006255944B1

(12) United States Patent
Addy

(10) Patent No.: US 6,255,944 B1
(45) Date of Patent: Jul. 3, 2001

(54) REMOTE INDICATION DEVICE FOR USE IN WIRELESS SECURITY SYSTEMS

(75) Inventor: Kenneth L. Addy, Massapequa, NY (US)

(73) Assignee: Pittway Corp., Chicago, IL (US)

( * ) Notice: Subject to any disclaimer, the term of this patent is extended or adjusted under 35 U.S.C. 154(b) by 0 days.

(21) Appl. No.: 08/998,435

(22) Filed: Dec. 26, 1997

(51) Int. Cl.[7] ..... G08B 1/08

(52) U.S. Cl. ..... 340/539; 340/506; 340/511; 340/825.31; 340/825.32

(58) Field of Search ..... 340/502, 504, 340/506, 693, 825.18, 825.31, 825.34, 825.69, 825.72, 292, 298, 314

(56) References Cited

U.S. PATENT DOCUMENTS

| | | | | |
|---|---|---|---|---|
| 3,833,895 | | 9/1974 | Fecteau . | |
| 3,866,206 | * | 2/1975 | Degiorgio et al. | 340/298 |
| 4,023,139 | | 5/1977 | Samburg . | |
| 4,092,643 | | 5/1978 | Stolarczyk . | |
| 4,257,038 | | 3/1981 | Rounds et al. . | |
| 4,692,762 | | 9/1987 | Lewiner et al. . | |
| 4,754,255 | | 6/1988 | Sanders et al. . | |
| 4,908,604 | | 3/1990 | Jacob . | |
| 5,594,428 | | 1/1997 | Peterson . | |

* cited by examiner

*Primary Examiner*—Daryl Pope
(74) *Attorney, Agent, or Firm*—Greenberg Traurig, LLP; Anthony R. Barkume

(57) ABSTRACT

A wireless security system having a remote indication device, which operates in a low power mode. The remote indication device provides feedback in the form of a display indicating that a command from a remote control device has been successfully performed or to provide status. The user transmits a first radio frequency signal with a remote control device that is received by a first receiver in the remote indication device during a reduced current mode. The remote indication device then switches to normal current mode, which enables a second receiver, a transmitter, a processing unit and optionally disables the first receiver. The transmitter then retransmits the contents of the first radio frequency signal as a second radio frequency signal to a central control unit via a central receiver. The central control unit then transmits a confirmation or status message back to the remote indication device via a central transmitter in the form of a confirmation radio frequency signal. The remote indication device provides a presentation of the contents of the confirmation radio frequency signal on a presentation unit before returning to the reduced current mode in which the second receiver, transmitter, presentation unit, and processing unit are disabled and the first receiver is enabled. The status is optionally stored in the remote indication device, which enables the status to be re-presented upon request by the user. Alternatively, one receiver may include both the first and second receivers and operate in either the normal operating mode or the reduced power mode.

43 Claims, 4 Drawing Sheets

REMOTE INDICATION DEVICE FOR USE IN WIRELESS SECURITY SYSTEMS

BACKGROUND OF THE INVENTION

The present invention relates to wireless security systems and in particular to wireless security systems having remote indication devices that provide feedback to a user.

A recent innovation in security system applications is the use of wireless bi-directional consoles or display units, which are portable wireless devices that control and interrogate the security system for status. For example, two such wireless bi-directional consoles (5827BD and 5804BD) are manufactured by Alarm Device Manufacturing Company (Ademco) 165 Eileen Way, Syosset, N.Y. 11791. Wireless bi-directional consoles have the advantage of portability if required, or may be permanently mounted, thereby reducing the additional cost of wiring a conventional wired console. Prior art devices of this type include a wireless transmitter and a wireless receiver. The wireless transmitter transmits control commands and status requests to a central receiver in communication with a central control system. The wireless receiver receives confirmation of the control command and status information which is transmitted from a central transmitter also in communication with the central control unit. The confirmation or status is then displayed to the user on the wireless bi-directional console.

A disadvantage of this approach is that the wireless bi-directional console, due to the inclusion of a receiver, is physically larger and significantly more expensive than a unidirectional ("transmit only") device. The additional size and cost of such units becomes particularly prohibitive in commercial installations where a large number of wireless bi-directional consoles may be in use at any given time. In such a multi-user environment, the additional cost of portable transceivers generally forces the user to install unidirectional devices rather than their bi-directional counterparts.

Therefore, it would be advantageous if the size and cost of wireless bi-directional consoles in multi-user environments could be reduced while providing a practical means for transmitting control commands and status requests to and obtaining confirmation and status from the central control unit.

One solution has been to provide a wired remote indication device that operates from AC power. The wired remote indication device displays status and confirmation of commands to the user within a relatively short range from the central control unit. However, strategic positioning of such a wired remote indication device to provide optimal site coverage, wireless propagation characteristics, and visibility to the user may not be near enough to an AC power source. The installer of such a security system must either compromise the optimal location of the device or install a potentially expensive power line to the device, thereby negating the advantages of an otherwise wireless installation.

Therefore, it would be advantageous if a remote indication device could be entirely wireless, thus enabling its installation to be optimized with respect to wireless signal propagation and visibility of the display to the user without regard to the location of AC power sources.

SUMMARY OF THE INVENTION

In accordance with the present invention a method provides status to a user in wireless communication systems which comprises the steps of receiving a first radio frequency signal while operating in a reduced power mode, switching from a reduced power mode to a normal operating mode, transmitting a second radio frequency signal comprising data representative of data comprised in the first radio frequency signal while operating in the normal operating mode, receiving a confirmation radio frequency signal while operating in the normal operating mode, presenting the status data to the user, and switching from the normal operating mode to the reduced power mode after a predetermined time has expired. The confirmation radio frequency signal is transmitted in response to receipt of the second radio frequency signal and includes status in response to the second radio frequency signal.

In further accordance with the method of the present invention the status data may be stored for a timeout period; and re-presented to the user in response to receipt of a another transmission of the first radio frequency signal prior to lapse of the timeout period. Identification information may be included in the radio frequency signals representing the source of the particular radio frequency signal.

In accordance with the present invention a remote indication device is provided which comprises a radio frequency receiver adapted to operate in a reduced power mode and a normal operating mode, a transmitter operating in a normal operating mode, a display, and a processor module coupled to the radio frequency receiver, the transmitter, and the display. The processor module is adapted to switch the remote indication device from the reduced power mode to the normal operating mode upon receipt of a first radio frequency signal by the radio frequency receiver while operating in the reduced power mode. The processor module is also adapted to cause the transmitter to transmit a second radio frequency signal comprising data representative of data comprised in the first radio frequency signal. The processor module is also adapted to enable the radio frequency receiver while operating in the normal operating mode to receive a confirmation signal transmitted in response to receipt of the second radio frequency signal and comprising status data in response to the second radio frequency signal. The processor module is also adapted to enable the display to display the status data to the user, and to switch from the normal operating mode to the reduced power mode after a predetermined time has expired.

In further accordance with the remote indication device of the present invention the processor module is adapted to include information in the second radio frequency signal indicating its source and to determine the source of the first radio frequency signal and the confirmation radio frequency signal. The processor module is adapted to store the status data and redisplay the status data to the user upon receipt of a subsequent instance of the first radio frequency signal received prior to lapse of a timeout period.

In further accordance with the present invention a security system is provided which comprises a remote control device, a central control unit comprising a central receiver and a central transmitter and a plurality of remote indication devices. The remote indication devices comprise a first radio frequency receiver operating in a reduced power mode, a transmitter operating in a normal operating mode, a second radio frequency receiver operating in the normal operating mode, a display, and a processor module coupled to the first radio frequency receiver, the transmitter, the second radio frequency receiver and the display.

DETAILED DESCRIPTION OF THE PREFERRED EMBODIMENT

Figure 1:
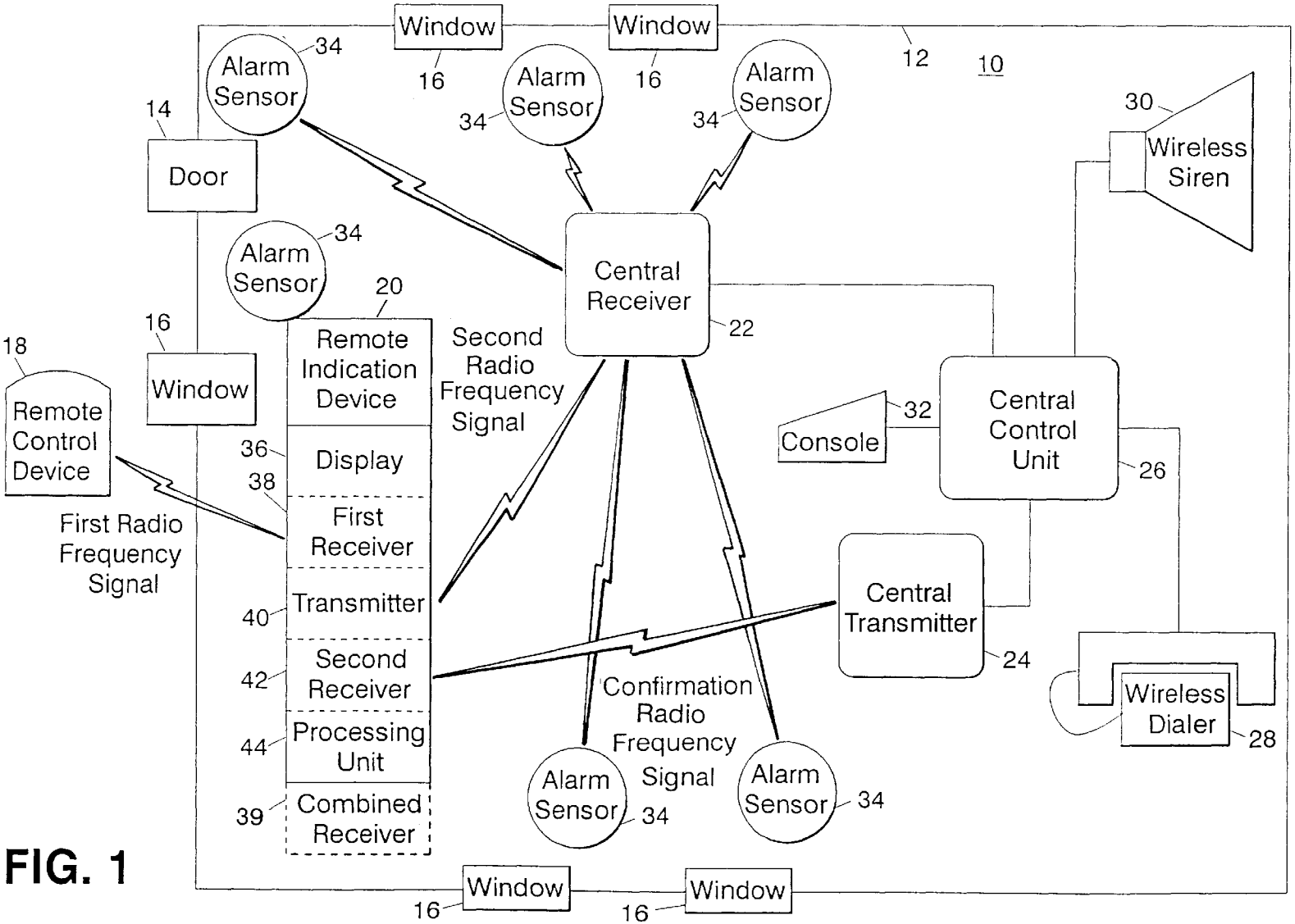
FIG. 1 illustrates a block diagram of a security system utilizing a wireless remote indication device of the present invention.

FIG. 1 illustrates application of a wireless security system 10 in a building 12 comprising at least one door 14 and a plurality of windows 16. The wireless security system 10 comprises a remote control device 18, a remote indication device 20, a central receiver 22, a central transmitter 24, a central control unit 26, a wireless dialer 28, a wireless siren 30, a console 32 and alarm sensors 34 located at the door 14 and each window 16. The alarm sensors 34 detect entry into the door 14 and windows 16 by any of various means well known in the art (e.g., closure detectors) and transmit signals representing this to the central receiver 22.

The remote control device 18 is portable and typically carried by one or more users authorized for access to a secured area such as the building 12. The user transmits a first radio frequency signal from the remote control device 18, comprising a message consisting of commands such as arming or disarming the wireless security system 10 or a status request. The user initiates such a message by depressing one or more buttons found on the remote control device 18. The user is typically located at a first distance relatively near the remote indication device 20 such as thirty to forty feet.

The remote indication device 20 comprises a display 36, a first receiver 38, a transmitter 40, a second receiver 42 and a processing unit 44. Since the remote control device 18 is ideally designed to be relatively small, handheld, lightweight, operable from watch batteries and inexpensive, the transmission circuitry contained therein typically has a very limited range requiring that the first distance be relatively short. In addition, since the remote indication device 20 is generally mounted in such a way as to permit the user to read the display 36 while looking through the window 16, the user would be required to be relatively near the remote indication device 20 during transmission of the first radio frequency signal.

Ideally, the remote indication device 20 is entirely wireless and operates from primary cells or batteries. A completely wireless remote indication device 20 is significantly easier and less costly to install. In addition, an optimal mounting location, in terms of radio frequency propagation and visibility of the display 36 to the user through the window 16, may be chosen for the device without regard to the location of AC power sources. However, in order to operate solely on batteries the device must draw a minimum of current and the range of reduced current receivers is typically very poor and such receivers can not generally operate at high sensitivity. The remote indication device 20 of the present invention solves these problems with two receivers while retaining an entirely wireless operation.

The remote indication device 20 remains in a reduced power or current mode while waiting for transmission of the first radio frequency signal from the remote control device 18. During the reduced current mode only the first receiver 38 is enabled and it is required that the first receiver 38 operate on relatively low current while waiting for transmission of the first radio frequency signal. Upon receipt of the first radio frequency signal a normal current mode is entered wherein the first receiver 38 could optionally be disabled while the remainder of the elements of the remote indication device 20 (i.e. the transmitter 40, second receiver 42, processing unit 44 and display 36) are enabled. The transmitter 40 then transmits a second radio frequency signal representative of the first radio frequency signal to the central receiver 22.

The central receiver 22 is located at a second distance from the remote indication device 20 (typically in the range of several hundred feet), which is greater than the first distance for a number of reasons. Firstly, it is advantageous to locate the central control unit 22, wireless siren 30 and wireless dialer 28 at a substantial distance from the remote indication device 20 in order to make it difficult for one who enters the door 14 or the window 16 without authorization from destroying the central control unit 26 before it has a chance to initiate an alarm condition. Secondly, in order to take full advantage of wireless installation, the remote indication device 20 will be installed in an optimal location with respect to signal propagation characteristics and visibility to the user which may result in being some distance from an AC power source.

Upon receipt of the second radio frequency signal by the central receiver 22, the central receiver 22 transfers information regarding the second radio frequency signal to the central control unit 26. The central control unit 26 will take appropriate action such as enabling the wireless siren 30 or the wireless dialer 28 and displaying a message on the console 32. The central control unit 22 then generates a confirmation message based on the contents of the second radio frequency signal and transfers the confirmation message to the central transmitter 24. The confirmation message may comprise confirmation that the command transmitted by the remote control device 18 was successfully performed, the status of the security system or any additional information appropriate for display to the user. The central transmitter 24 transmits the confirmation message as a confirmation radio frequency signal to the second receiver 42 in the remote indication device 20. The processing unit 44 in the remote indication device receives the confirmation message from the second receiver 42 and transfers all or a portion of its contents to the display 36 for presentation to the user. At a predetermined time following display to the user the remote indication device 20 will again enter the reduced current mode by disabling the transmitter 40, second receiver 42, processing unit 44, and display 36 in order to conserve battery power. In addition, the first receiver 20 is enabled in reduced current mode in preparation for receipt of the next radio frequency signal.

An important concept in the present invention is the inclusion of the first receiver 38 and the second receiver 42 in the remote indication device 20. The first receiver 38 is a very low current design that is substantially continuously enabled. The first receiver 38 is typically a low-cost super-regenerative receiver, a tuned RF receiver, a diode detector receiver or equivalent design well known in the art. Greater detail regarding these designs is provided in U. Rohde, J. Whitaker, and T. T. N. Bucher *Communications Receivers: Principles and Designs* pp. 35–39 ($2^{nd}$ edition) and L. J. Giacoletto *Electronics Designers' Handbook* sections 20–25 (1977), which are hereby incorporated by reference. Upon receipt of the first radio frequency signal from the remote control device 18, operating over relatively short range or first distance, the first receiver is temporarily disabled and the second receiver 42, comprising greater range, sensitivity and operating current, is temporarily enabled during the normal current mode. The contents of the first radio frequency signal are retransmitted by the transmitter 40 to the central receiver 22 during the normal current mode.

The second receiver 42 is typically a superheterodyne receiver, which consumes too much current to be enabled during the reduced current mode. However, since the second receiver 42 is enabled only a relatively short time during the normal power mode, the remote indication device 20 may continue to operate entirely from batteries. The central control unit 26 transmits a confirmation radio frequency signal to the remote indication device 20 via the central transmitter 24, which is received by the second receiver 42. As a consequence of this message, the remote indication device provides an appropriate display to the user for a short period of time after which it shifts back into low-current mode. Low current mode is characterized by the disabling of the entire remote indication device 20 with the exception of the first receiver 38. The remote indication device 20 remains in low current mode until another radio frequency signal is received from the remote control device 18. In a typical scenario, the remote indication device 20 would be mounted so that it is clearly visible to the user, for example, in a window close to an access point of a building, as shown in FIG. 1.

Therefore, the inclusion of two receivers permits the remote indication device 20 to operate on an entirely wireless basis while providing bi-directional communication with the central control unit 26 as well as feedback to the user regarding his commands or requests for status. Furthermore, the potentially prohibitive size and cost of including such capability in each remote control device in a multi-user application is averted.

Alternatively, the first receiver 38 and the second receiver 42 could be realized by one receiver circuit capable of operating in two modes, namely the normal operating mode and the reduced current mode. Such a receiver could achieve operation in two modes by modifying the duty cycle of on-time versus off-time. Alternatively, such a receiver could be operated at different current levels resulting in different levels of performance. However, this is not typically done and may result in unreliable operating characteristics. One embodiment of such a receiver design is substantially similar to that used in pagers wherein the duty cycle of the current supplied to the receiver is modified to achieve the normal and reduced current modes. For instance, the combined receiver 39 (which can operate in two modes) could be enabled with operating current only once every five seconds in a normal operating mode. The transmission circuitry in the remote control device 18 is enabled and remains enabled for at least five seconds to enable the combined receiver 39 to receive the first radio frequency signal. Upon receipt of the first radio frequency signal the combined receiver 39 will enter the normal operating mode, in which it is substantially continuously enabled, until the confirmation radio frequency signal is received from the central transmitter 24. Naturally, the combined receiver 39 could remain in reduced current mode while waiting for the confirmation radio frequency signal if the central transmitter 24 transmitted the confirmation radio frequency signal in a substantially similar way to the remote control device 18 by continuously transmitting the message for at least 5 seconds. However, the disadvantage of increasing the length of time that the central transmitter 24 transmits the confirmation radio frequency signal is that the "on-air time" is longer which creates a greater potential for clash or interference with other radio frequency transmissions.

In summary, the user transmits the first radio frequency signal via the remote control device 18, which is received by the first receiver 38 in the remote indication device 20 during a reduced current mode. The remote indication device 20 then switches to normal current mode, which enables the second receiver 42, the transmitter 40, the processing unit 44 and optionally disables the first receiver 38. The transmitter 40 then retransmits the content of the first radio frequency signal as a second radio frequency signal to the central control unit 26 via the central receiver 22. The central control unit 26 then transmits the confirmation or status message back to the remote indication device 20 via the central transmitter 24 in the form of the confirmation radio frequency signal. The remote indication device 20 provides a display of the contents of the confirmation radio frequency signal on the display 36 before returning to the reduced current mode in which the second receiver 42, transmitter 40, display 36, processing unit 44 are disabled and the first receiver 38 is enabled.

If the first radio frequency signal and the second radio frequency signal are transmitted at substantially the same frequency, such as within 10 Mhz, it is necessary to disable the first receiver 38 at the time the second receiver 42 is enabled if superregenerative receivers are used. This is due to the fact that superregenerative receivers may interfere with co-located receivers operating at the same frequency. Those skilled in the art will recognize that the remote control device 18 and the first receiver 38 may operate at a different frequency from the second receiver 42 and the central transmitter 24, in which case it is not necessary to disable the first receiver 38 upon enabling the second receiver 42.

The processing unit 44 generates message formats and protocols for the second radio frequency signals and decodes incoming data streams from the first radio frequency signal and the confirmation radio frequency signal as well as controlling the display 36, the power of the second radio frequency signal and overall timing in the remote indication device 20.

Figure 2A:
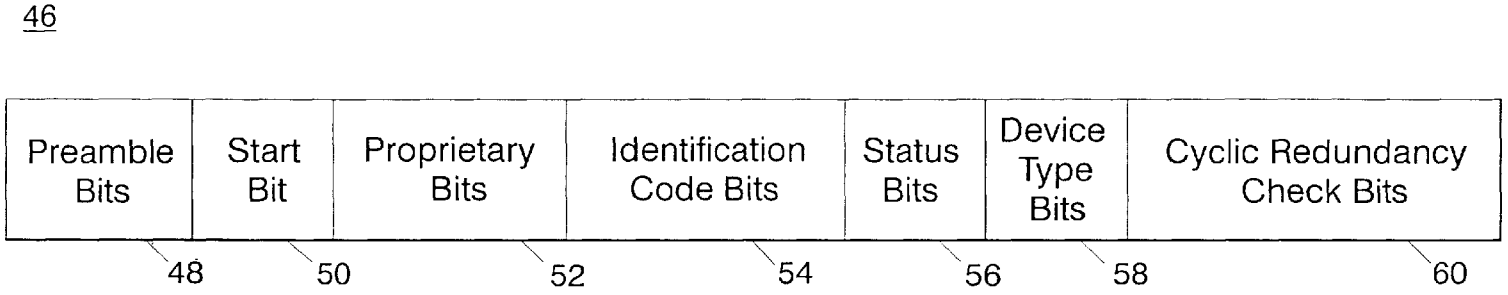
FIG. 2A illustrates the format of a radio frequency signal utilized by the wireless security system of FIG. 1.

FIG. 2A illustrates one embodiment of a message format 46 for the first, second and confirmation radio frequency signals. The message format 46 comprises preamble bits 48, a start bit 50, proprietary bits 52, identification code bits 54, status bits 56, device type bits 58, and cyclic redundancy check bits 60. The preamble bits 48 are used to obtain timing information from the received radio frequency signal. If the preamble bits 48 are transmitted by the remote control device 18 to the remote indication device 20, some of the bits are used by the superregenerative receiver to enable the processing unit 44 to synchronize to the timing of the preamble bits 48 by means well known in the art. The start bit 50 separates the preamble bits 48 from the remainder of the message format. The proprietary bits 52 provide a code that enables the security system to generate unique system messages corresponding to different security system installers. The identification code bits 54 identify the specific remote control device which transmitted the radio frequency signal and prevents signals from neighboring security systems from being interpreted incorrectly. The status bits 56 convey information such as the type of alarm sensor (e.g., fire detector, glass breakage detector, motion sensor) a low-battery condition, the message type, etc. The device type bits 58 indicate the source of the transmission as being the alarm sensors 34, the remote indication device 20, the remote control device 18 or the central transmitter 24. Finally, the cyclical redundancy check bits 60 are used for error checking the contents of the radio frequency signals.

Figure 2B:
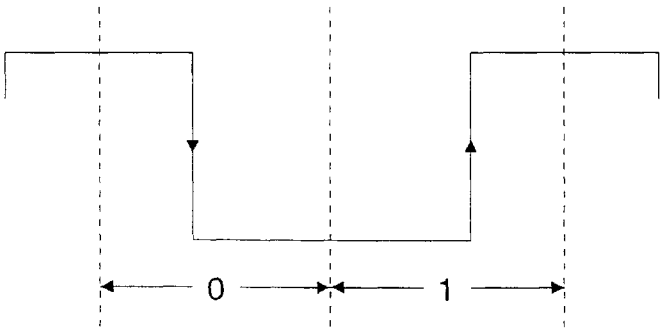
FIG. 2B (Prior Art)
FIG. 2B illustrates Manchester Bi-phase encoding utilized to encode bits in the format of FIG. 2A.

Typical system messages are encoded using a suitable baseband encoding technique such as Manchester Bi-phase encoding as illustrated in FIG. 2B, which is bandwidth efficient and permits low cost decoding methods. As shown in FIG. 2B, a zero bit is represented as a falling edge and a one bit is represented as a rising edge.

Figure 3:
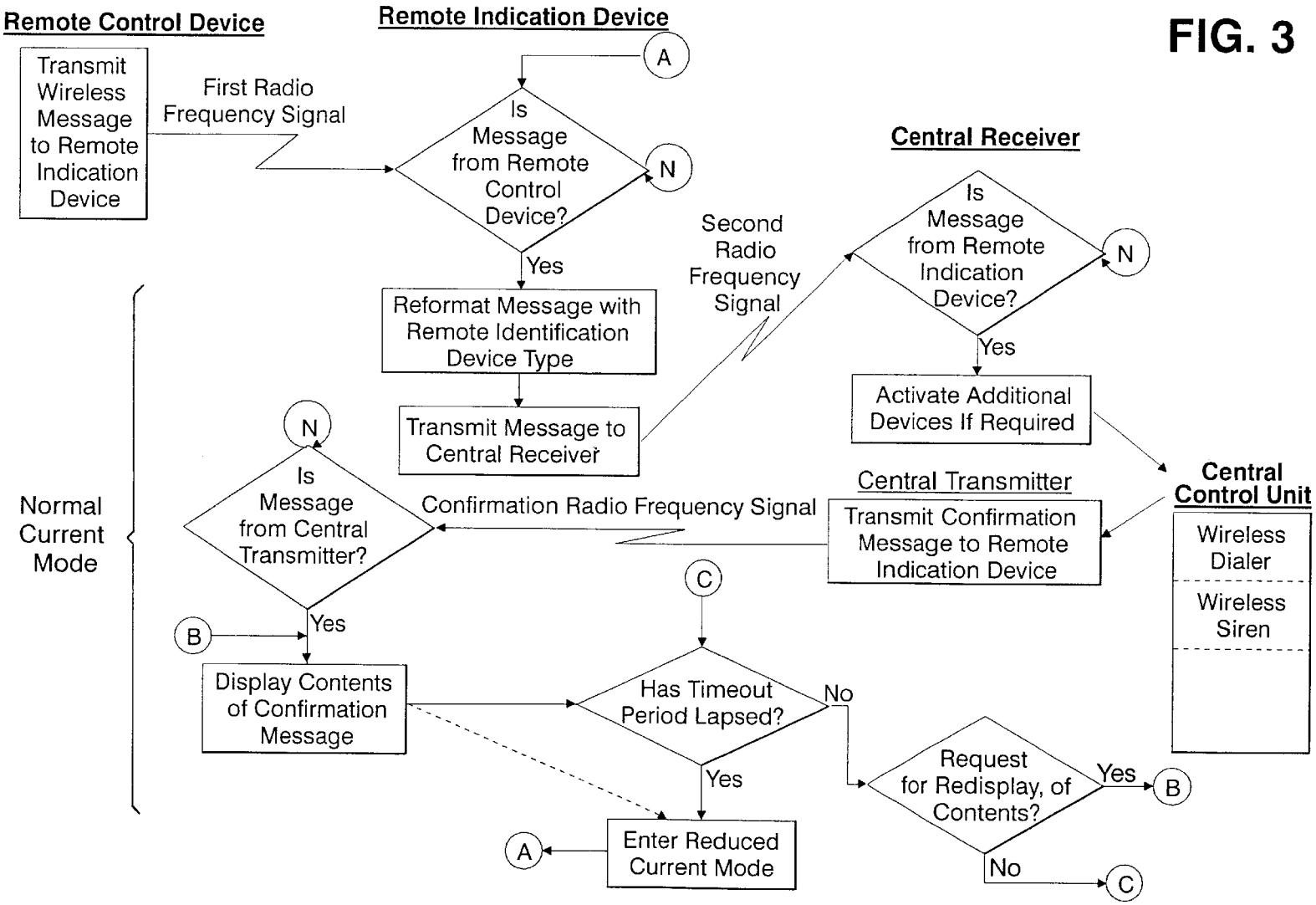
FIG. 3 is a flow chart illustrating the operation of the wireless remote indication device of FIG. 1.

FIG. 3 is a relational flowchart which illustrates the operation of the remote indication device of the present invention. The process begins with the remote control device transmitting a first radio frequency signal comprising a wireless message to the remote indication device. Prior to receipt of the first radio frequency signal the remote indication device will be in the reduced current mode in order to conserve battery power. The reduced current mode is characterized by the first receiver being the only component of the remote indication device enabled.

Upon receipt of the wireless message in the first radio frequency signal, the remote indication device enters the normal power mode. In the normal power mode the second receiver, the transmitter, the processing unit and the display are enabled and the first receiver is optionally disabled. The remote indication device analyzes the device type bits in the wireless message of the first radio frequency signal. If the device type bits indicate that the message was transmitted by the remote control device, the message will be reformatted with device type bits indicating that the message is transmitted from the remote indication device. Alternatively, the device type bits for the remote control device could be stored in the central control unit, which could verify the bits upon receipt of the second radio frequency signal. The advantage of storing the device type bits of the remote control device in the remote indication device is that if the system is not required to wake-up in response to a specific first radio frequency signal then the remote indication device can determine not to wake-up, thereby conserving the power required to wake-up the remainder of the system. However, the disadvantage is that a method of learning the device type bits into the remote indication device must be developed which can add complexity and cost to the system. Conversely, the disadvantage of storing the device type bits for the remote control device in the central control unit is an increase in on-air time and power consumption.

All or a portion of the contents of the message are then retransmitted as the second radio frequency signal to the central receiver. Upon receipt of the second radio frequency signal by the central receiver, the information contained in the second radio frequency signal is made available to the central control unit. The central control unit verifies that the device type bits indicate a transmission from the remote indication device and may perform additional tasks such as activation of the wireless dialer and siren. The central control unit then provides the confirmation message to the central transmitter that is then transmitted by the central transmitter as the confirmation radio frequency signal. The confirmation radio frequency signal comprises device type bits indicating that the message contained therein was transmitted from the central transmitter.

Upon receipt of the confirmation radio frequency signal, the device type bits are again verified by the remote indication device as being transmitted from the central transmitter and the appropriate display is made comprising all or a portion of the contents of the confirmation radio is frequency signal. The display is activated for a predetermined time enabling the user to read the display (5–10 seconds), and is then disabled prior to entering reduced current mode. Alternatively, the display could be enabled for a timeout period within which the user could request that the contents of the confirmation message be redisplayed if, for instance, the user missed seeing it the first time. Thus, the display is initially enabled for only a relatively short time in order to conserve current and to limit the amount of time that the status of the security system is visible by potentially unauthorized users. Thereafter, the display will blank and if the user, prior to the lapse of the timeout period, requests a redisplay, then the contents of the confirmation message will be redisplayed without the necessity of transmitting another message to the central receiver. If the timeout period has lapsed then the normal operating or reduced current mode will be entered.

The remote indication device can redisplay the contents of the confirmation message within the timeout period by, for instance, storing this information in a temporary location in memory within the processing unit. The power to the temporary memory location could be removed and/or the location could be zeroed following the timeout period according to system requirements. Thus, the user is provided with an additional chance to see the display while not requiring additional battery power in enabling the transmitter and second receiver.

Figure 4:
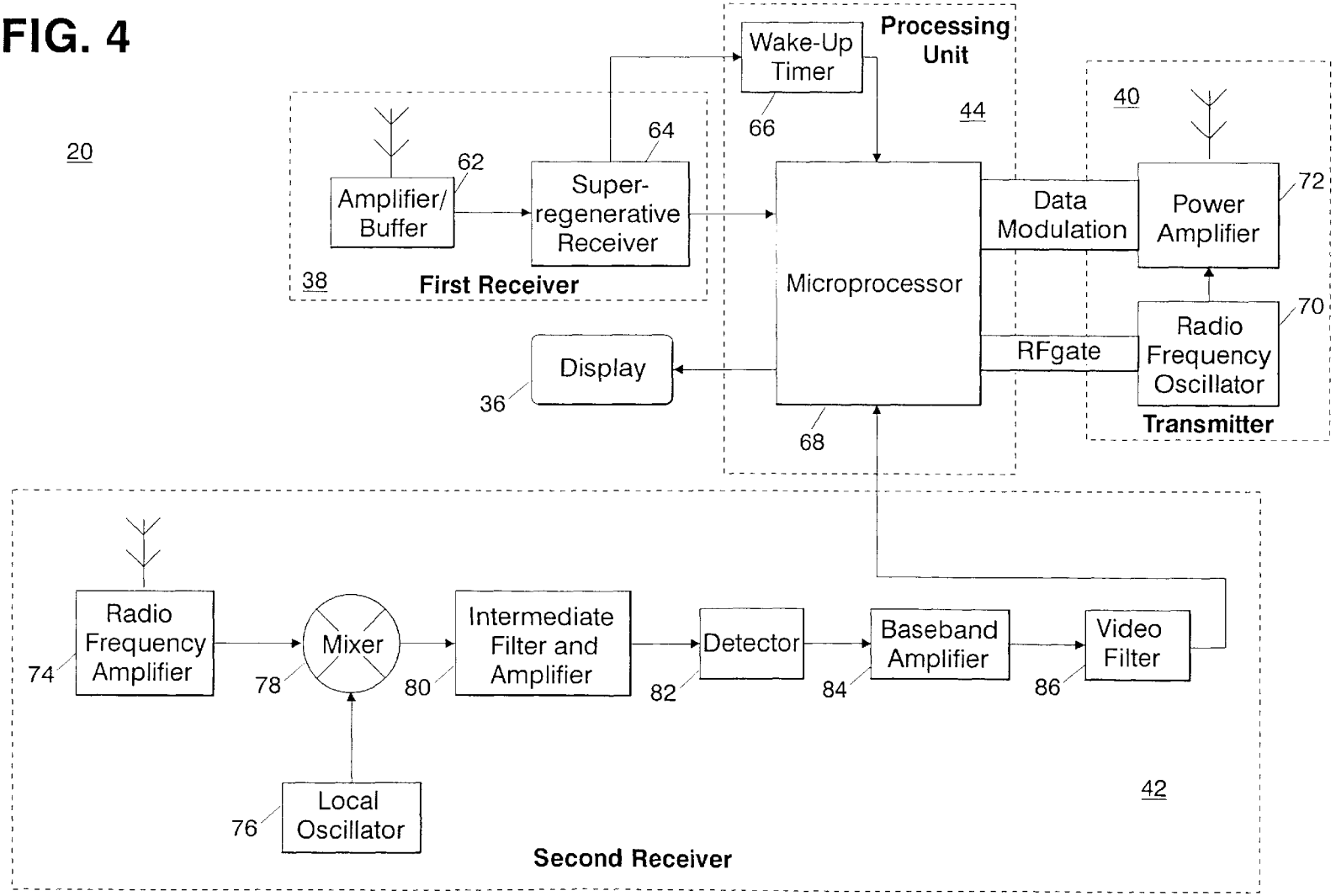
FIG. 4 is a block diagram of the wireless remote indication device of FIG. 1.

FIG. 4 illustrates a block diagram of the remote indication device comprising the first receiver 38, the second receiver 42, the processing unit 44 and the transmitter 40. The first receiver 38 comprises an amplifier/buffer 62 and a superregenerative receiver 64. In reduced current mode, only the amplifier/buffer 62 and the superregenerative detector 64 are enabled, both of which operate with only a few micro amps of current using MPSH10 transistors manufactured by Motorola Corporation. When a thresholding circuit in the superregenerative receiver 64 detects energy of sufficient intensity in a band of interest or pass band, a wake-up timer 66 switches power to a microprocessor 68 that begins to scan the incoming message for correctly timed and formatted preamble bits. The thresholding circuit is required in order to prevent premature drainage of the batteries due to wake-ups initiated by low energy noise. If the device type bits indicate that the message was transmitted from the remote control device, the normal current mode is entered.

The second receiver 42 is illustrated as a superheterodyne receiver comprising a low noise radio frequency amplifier 74 (comprising an NEC2133 transistor manufactured by NEC Corporation), a local oscillator 76 (comprising a crystal and a BFS17 transistor manufactured by Phillips Corporation), a mixer 78 (comprising an NE612 mixer integrated circuit manufactured by Phillips Corporation), an intermediate frequency amplifier and detector 80 (comprising an NE614 I.F. amplifier manufactured by Phillips Corporation), a detector 82, a baseband amplifier 84 and a video filter 86 (comprising an LF358 operational amplifier manufactured by National Semiconductor Corporation). A number of substantially equivalent receivers well known in the art may be substituted for the superheterodyne receiver in the second receiver 42. Details regarding such receivers are provided in R. Dorf, *The Electrical Engineering Handbook* (1993), which is hereby incorporated by reference.

A radio frequency oscillator 70 comprising a SAW resonator and an MMBR911 transistor (manufactured by Motorola Corporation) is enabled, simultaneously with the second receiver 42, by an RF gate signal from the microprocessor 68. Approximately one to two milliseconds are provided for the radio frequency oscillator 70 to stabilize and then a power amplifier 72 (comprising an MMBR911 transistor manufactured by Corporation) is modulated by a data modulation signal from the microprocessor 68. The data modulation signal comprises information to be contained in the second radio frequency signal.

The information contained in the second radio frequency signal is received by the central receiver and processed by the central control unit. The confirmation radio frequency signal is transmitted by the central transmitter and received by the second receiver 42. The information derived from the confirmation radio frequency signal by the second receiver 42 is transferred to the microprocessor 68, which then provides the display 36 with information contained in the confirmation radio frequency signal. Following a predetermined period of time, the remote indication device returns to the reduced current mode in which only the amplifier/buffer 62 and the superregenerative receiver 64 are enabled.

The following alterations could be made in additional embodiments of the present invention without exceeding the scope of the present invention:

1. the precise timing for enabling and disabling each of the components of the remote indication device may be altered with respect to each other and the reduced and normal current modes, so long as each of the components are enabled when their functionality is required and the goal of conserving battery power is adhered to;
2. the power and frequency of the first, second and confirmation radio frequency signals may be altered with respect to each other;
3. the sensitivity and required operating current of the first receiver, second receiver, transmitter, central transmitter, and central receiver may be varied with respect to each other so long as the remote indication device remains wireless;
4. the number of remote control devices and remote indication devices may be increased; and
5. the first distance and the second distance may be varied with respect to each other (e.g., the first distance may be greater or less than the second distance).

Although the invention has been shown and described with respect to best mode embodiments thereof, it should be understood by those skilled in the art that the foregoing and various other changes, omissions and additions in the form and detail thereof may be made therein without departing from the spirit and scope of the invention.

I claim:

1. A method for providing status to a user in wireless communication systems comprising the steps of:

receiving a first radio frequency signal while operating in a reduced power mode;

switching from said reduced power mode to a normal operating mode;

transmitting a second radio frequency signal comprising data representative of data comprised in said first radio frequency signal while operating in said normal operating mode;

receiving a confirmation radio frequency signal while operating in said normal operating mode, said confirmation radio frequency signal transmitted in response to receipt of said second radio frequency signal and comprising status data in response to said second radio frequency signal;

presenting said status data to said user; and switching from said normal operating mode to said reduced power mode after a predetermined time has expired, wherein said first radio frequency signal is received over a first distance and said confirmation radio frequency signal is received over a second distance which is longer than said first distance.

2. The method for providing status to a user in wireless communication systems of claim 1, further comprising the steps of storing said status data for a timeout period; and re-presenting said status data to said user in response to receipt of a subsequent instance of said first radio frequency signal prior to lapse of said timeout period.

3. The method for providing status to a user in wireless communication systems of claim 1, further comprising the step of analyzing said first radio frequency signal to determine its source.

4. The method for providing status to a user in wireless communication systems of claim 1, further comprising the step of including information identifying a source of said second radio frequency signal prior to said step of transmitting said second radio frequency signal.

5. The method for providing status to a user in wireless communication systems of claim 1, further comprising the step of analyzing said confirmation radio frequency signal to determine its source.

6. The method for providing status to a user in wireless communication systems of claim 1, wherein said step of presenting said status data comprises the step of providing a visual representation of said status data to said user.

7. The method for providing status to a user in wireless communication systems of claim 1, wherein said step of presenting said status data comprises the step of providing an audible representation of said status data to said user.

8. An apparatus for providing status to a user in wireless communication systems which comprises:

means for receiving a first radio frequency signal while operating in a reduced power mode;

means for switching from a reduced power mode to a normal operating mode;

means for transmitting a second radio frequency signal comprising data representative of data comprised in said first radio frequency signal while operating in said normal operating mode;

means for receiving a confirmation radio frequency signal while operating in said normal operating mode, said confirmation radio frequency signal transmitted in response to receipt of said second radio frequency signal and comprising status in response to said second radio frequency signal;

means for presenting said status data to said user; and means for switching from said normal operating mode to said reduced power mode after a predetermined time has expired, wherein said first radio frequency signal is received over a first distance and said confirmation radio frequency signal is received over a second distance which is longer than said first distance.

9. The apparatus for providing status to a user in wireless communication systems of claim 8, further comprising means for storing said status data for a timeout period; and means for re-presenting said status data to said user in response to receipt of a subsequent instance of said first radio frequency signal prior to lapse of said timeout period following said status data being presented to said user.

10. The apparatus for providing status to a user in wireless communication systems of claim 8, further comprising means for analyzing said first radio frequency signal to determine its source.

11. The apparatus for providing status to a user in wireless communication systems of claim 8, further comprising means for including information identifying a source of said second radio frequency signal prior to said second radio frequency signal being transmitted.

12. The apparatus for providing status to a user in wireless communication systems of claim 8, further comprising means for analyzing said confirmation radio frequency signal to determine its source.

13. The apparatus for providing status to a user in wireless communication systems of claim 8, wherein said means for presenting said status data provides a visual representation of said status data to said user.

14. The apparatus for providing status to a user in wireless communication systems of claim 8, wherein said means for presenting said status data provides an audible representation of said status data to said user.

15. A remote indication device which comprises:

a first radio frequency receiver operating in a reduced power mode;

a transmitter operating in a normal operating mode;

a second radio frequency receiver operating in said normal operating mode;

a presentation unit; and a processor module coupled to said first radio frequency receiver, said transmitter, said second radio frequency receiver and said presentation unit, said processor module adapted to switch said remote indication device from said reduced power mode to said normal operating mode upon receipt of a first radio frequency signal by said first radio frequency receiver, said processor module adapted to cause said transmitter to transmit a second radio frequency signal comprising data representative of data comprised in said first radio frequency signal, said processor module adapted to enable said second radio frequency receiver to receive a confirmation signal transmitted in response to receipt of said second radio frequency signal and comprising status data in response to said second radio frequency signal, said processor module adapted to enable said presentation unit to present said status data to said user, and said processor module adapted to switch from said normal operating mode to said reduced power mode after a predetermined time has expired, wherein said first radio frequency signal is received from a first distance and said confirmation radio frequency signal is received over a second distance which is longer than said first distance.

16. The remote indication device of claim 15, wherein said processor module is adapted to switch from said normal operating mode to said reduced power after a predetermined time has expired following said presentation of said status data to said user.

17. The remote indication device of claim 15, wherein said first radio frequency receiver is only enabled during said reduced power mode.

18. The remote indication device of claim 15, wherein said first radio frequency receiver comprises a superregenerative receiver.

19. The remote indication device of claim 15, wherein said first radio frequency receiver comprises a tuned radio frequency receiver.

20. The remote indication device of claim 15, wherein said presentation unit provides a visual representation of said status data to said user.

21. The remote indication device of claim 15, wherein said presentation unit provides an audible representation of said status data to said user.

22. The remote indication device of claim 15, wherein said processor module is adapted to determine a source of said first radio frequency signal.

23. The remote indication device of claim 15, wherein said processor module is adapted to determine a source of said confirmation radio frequency signal.

24. The remote indication device of claim 15, wherein said processor module is adapted to include an identification code in said second radio frequency signal which represents that said second radio frequency signal originated from said remote indication device.

25. The remote indication device of claim 15, wherein said first radio frequency receiver comprises a diode detector receiver.

26. The remote indication device of claim 15, wherein said processor module is adapted to store said status data and re-present said status data to said user upon receipt of a subsequent instance of said first radio frequency signal received prior to lapse of a timeout period.

27. A remote indication device which comprises:

a radio frequency receiver adapted to operate in a reduced power mode or a normal operating mode;

a transmitter operating in a normal operating mode;

a presentation unit; and a processor module coupled to said radio frequency receiver, said transmitter, and said presentation unit, said processor module adapted to switch said remote indication device from said reduced power mode to said normal operating mode upon receipt of a first radio frequency signal by said radio frequency receiver while operating in said reduced power mode, said processor module adapted to cause said transmitter to transmit a second radio frequency signal comprising data representative of data comprised in said first radio frequency signal, said processor module adapted to enable said radio frequency receiver while operating in said normal operating mode to receive a confirmation signal transmitted in response to receipt of said second radio frequency signal and comprising status data in response to said second radio frequency signal, said processor module adapted to enable said presentation unit to present said status data to said user, and said processor module adapted to switch from said normal operating mode to said reduced power mode after a predetermined time has expired, wherein said first radio frequency signal is received from a first distance and said confirmation radio frequency signal is received over a second distance which is longer than said first distance.

28. The remote indication device of claim 27, wherein said radio frequency receiver operates in said reduced power mode with an on-time to off-time duty cycle of less than that of its operation in said normal operating mode.

29. The remote indication device of claim 27, wherein said radio frequency receiver operates in said reduced power mode with less current than during operation in said normal operating mode.

30. The remote indication device of claim 27, wherein said processor module is adapted to switch from said normal operating mode to said reduced power mode after a predetermined time has expired following said presentation of said status data to said user.

31. The remote indication device of claim 27, wherein said radio frequency receiver comprises a superregenerative receiver.

32. The remote indication device of claim 27, wherein said radio frequency receiver comprises a tuned radio frequency receiver.

33. The remote indication device of claim 27, wherein said presentation unit is a display.

34. The remote indication device of claim 27, wherein said presentation unit is an audible.

35. The remote indication device of claim 27, wherein said processor module is adapted to determine a source of said first radio frequency signal.

36. The remote indication device of claim 27, wherein said processor module is adapted to determine a source of said confirmation radio frequency signal.

37. The remote indication device of claim 27, wherein said processor module is adapted to include an identification code in said second radio frequency signal which represents that said second radio frequency signal originated from said remote indication device.

38. The remote indication device of claim 27, wherein said radio frequency receiver comprises a diode detector receiver.

39. The remote indication device of claim 28, wherein said processor module is adapted to store said status data and re-present said status data to said user upon receipt of a subsequent instance of said first radio frequency signal received prior to lapse of a timeout period.

40. A security system which comprises:

a remote control device;

a central control unit comprising a central receiver and a central transmitter; and a remote indication device comprising a first radio frequency receiver operating in a reduced power mode, a transmitter operating in a normal operating mode, a second radio frequency receiver operating in said normal operating mode, a presentation unit, and a processor module coupled to said first radio frequency receiver, said transmitter, said second radio frequency receiver and said presentation unit, said processor module adapted to switch said remote indication device from said reduced power mode to said normal operating mode upon receipt of a first radio frequency signal by said first radio frequency receiver from said remote control device, said processor module adapted to cause said transmitter to transmit a second radio frequency signal comprising data representative of data comprised in said first radio frequency signal to said central control unit via said central receiver, said processor module adapted to enable said second radio frequency receiver to receive a confirmation signal transmitted by said central control unit via said central transmitter in response to receipt of said second radio frequency signal comprising status data in response to said second radio frequency signal, said processor module adapted to enable said presentation unit to present said status data to said user, and said processor module adapted to switch from said normal operating mode to said reduced power mode after a predetermined time has expired, wherein said processor module is adapted to determine a source of said first radio frequency signal.

41. The security system of claim 40, wherein said processor module is adapted to determine a source of said confirmation radio frequency signal.

42. The security system of claim 40, wherein said processor module is adapted to include an identification code in said second radio frequency signal which represents that said second radio frequency signal originated from said remote indication device.

43. The remote indication device of claim 40, wherein said processor module is adapted to store said status data and re-present said status data to said user upon receipt of a subsequent instance of said first radio frequency signal received prior to lapse of a timeout period.

* * * * *